US011035380B2

(12) United States Patent
Saito et al.

(10) Patent No.: US 11,035,380 B2
(45) Date of Patent: Jun. 15, 2021

(54) DIFFUSER VANE AND CENTRIFUGAL COMPRESSOR

(71) Applicant: MITSUBISHI HEAVY INDUSTRIES, LTD., Tokyo (JP)

(72) Inventors: Ryosuke Saito, Tokyo (JP); Jo Masutani, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/961,489

(22) PCT Filed: Mar. 8, 2019

(86) PCT No.: PCT/JP2019/009341

§ 371 (c)(1),
(2) Date: Jul. 10, 2020

(87) PCT Pub. No.: WO2019/172422

PCT Pub. Date: Sep. 12, 2019

(65) Prior Publication Data

US 2020/0386241 A1 Dec. 10, 2020

(30) Foreign Application Priority Data

Mar. 9, 2018 (JP) ..... JP2018-043595

(51) Int. Cl.
*F04D 29/50* (2006.01)
*F04D 29/44* (2006.01)

(52) U.S. Cl.
CPC ..... *F04D 29/444* (2013.01); *F04D 29/50* (2013.01); *F05D 2250/52* (2013.01); *F05D 2250/71* (2013.01)

(58) Field of Classification Search
None
See application file for complete search history.

(56) References Cited

U.S. PATENT DOCUMENTS 3,957,392 A * 5/1976 Blackburn ..... F04D 27/02 415/146
3,997,281 A * 12/1976 Atkinson ..... F04D 29/444 415/207

(Continued)

FOREIGN PATENT DOCUMENTS

JP 54-069811 6/1979
JP 08-232895 9/1996

(Continued)

OTHER PUBLICATIONS

International Search Report dated Jun. 4, 2019 in corresponding International (PCT) Application No. PCT/JP2019/009341, with English Translation.

(Continued)

*Primary Examiner* — Michael Lebentritt
(74) *Attorney, Agent, or Firm* — Wenderoth, Lind & Ponack, L.L.P.

(57) ABSTRACT

This diffuser vane (60), of which a blade height direction is aligned with an axial direction, has an airfoil shape in cross section orthogonal to the blade height direction, and comprises a body which, starting from a leading edge at the end on the radially inner side toward the radially outer side, extends toward the front side in an impeller rotating direction (R) and reaches a trailing edge at the end on the radially outer side. In the body of the diffuser vane, the turning angle of a shroud-side blade shape (S) that is the airfoil of an end face on one side in the axial direction is different from the turning angle of a hub-side blade shape (H) that is the airfoil of an end face on the other side in the axial direction. The airfoils form a transition continuously between the shroud-side blade shape and the hub-side blade shape. The turning angle of the hub-side blade shape is smaller than the turning angle of the shroud-side blade shape.

11 Claims, 7 Drawing Sheets

(56) References Cited

U.S. PATENT DOCUMENTS

| | | | | |
|---|---|---|---|---|
| 6,162,015 | A | 12/2000 | Nagai et al. | |
| 6,203,275 | B1 * | 3/2001 | Kobayashi | F04D 17/122 415/199.2 |
| 8,328,510 | B2 * | 12/2012 | Nakaniwa | F04D 29/661 415/208.1 |
| 2009/0035122 | A1 * | 2/2009 | Yagi | F04D 29/284 415/1 |
| 2011/0097203 | A1 | 4/2011 | Shibata et al. | |
| 2011/0135441 | A1 * | 6/2011 | Sorokes | F04D 17/12 415/1 |
| 2012/0014788 | A1 | 1/2012 | Blair et al. | |
| 2012/0186605 | A1 * | 7/2012 | Nakaniwa | F01D 25/002 134/24 |
| 2013/0094955 | A1 | 4/2013 | Ibaraki et al. | |
| 2015/0354591 | A1 * | 12/2015 | Ibaraki | F04D 17/10 415/147 |
| 2016/0327050 | A1 * | 11/2016 | Nakaniwa | F04D 17/122 |
| 2019/0178259 | A1 * | 6/2019 | McCabe | F25B 31/026 |
| 2019/0271328 | A1 * | 9/2019 | Grigoriev | F04D 29/444 |

FOREIGN PATENT DOCUMENTS

| | | |
|---|---|---|
| JP | 2011-89460 | 5/2011 |
| JP | 2012-52432 | 3/2012 |
| JP | 5010722 | 8/2012 |
| JP | 2013-531186 | 8/2013 |
| WO | 96/28662 | 9/1996 |

OTHER PUBLICATIONS

Written Opinion dated Jun. 4, 2019 in corresponding International (PCT) Application No. PCT/JP2019/009341, with English Translation.

* cited by examiner

DIFFUSER VANE AND CENTRIFUGAL COMPRESSOR

TECHNICAL FIELD

The present invention relates to a diffuser vane and a centrifugal compressor. Priority is claimed on Japanese Patent Application No. 2018-043595 filed on Mar. 9, 2018, the content of which is incorporated herein by reference.

BACKGROUND ART

PTL 1 discloses a centrifugal compressor including a diffuser vane. The diffuser vane is provided in a diffuser channel through which a fluid pressurized along from an impeller is guided to a radial outer side. The diffuser vane has an airfoil shape of which a blade height direction is aligned with an axial direction of the centrifugal compressor. The diffuser vane extends to a front side in a rotating direction of the impeller toward the radial outer side.

A return flow path that extends such that a stream of the fluid is turned toward a radial inner side is formed downstream of the diffuser channel. Since the speed of the fluid is reduced by the diffuser vane, loss in the return flow path is reduced and separation at a return vane provided in the return flow path is suppressed.

CITATION LIST

Patent Literature

[PTL 1] Japanese Patent No. 5010722

SUMMARY OF INVENTION

Technical Problem

Meanwhile, as the centrifugal compressor is reduced in diameter due to a request for cost reduction, an outer diameter at an outlet of the diffuser channel and an outer diameter at an inlet of the return vane are decreased. As a result, a flow speed at the return flow path is increased. On the other hand, when the diffuser vane is provided, the flow speed can be decreased by means of the diffuser vane. As a result, loss at the return flow path and separation at the return vane can be suppressed and thus it is possible to achieve an improvement in efficiency.

However, in a case where the speed of the fluid is excessively reduced by the diffuser vane, separation is likely to occur at the diffuser vane especially when a flow rate is low. As a result, there is a problem that an operation range becomes small at a low flow rate side in the centrifugal compressor.

The present invention has been made in view of such circumstances and an object thereof is to provide a diffuser vane and a centrifugal compressor with which it is possible to suppress reduction in size of an operation range.

Solution to Problem

The present invention adopts the following means in order to solve the above problems.

That is, according to a first aspect of the present invention, there is provided a diffuser vane which is provided in a diffuser channel through which a fluid that is sucked in by an impeller rotating around an axis from one side in an axial direction and is pressurized along to a radial outer side flows, a plurality of the diffuser vanes being provided in the diffuser channel at intervals in a circumferential direction of the axis and the diffuser vane including a vane body, of which a blade height direction is aligned with the axial direction, and which has an airfoil shape in cross section orthogonal to the blade height direction, extends toward a front side in a rotating direction of the impeller, starting from a leading edge at an end portion on a radial inner side toward the radial outer side, and reaches a trailing edge at an end portion on the radial outer side, in which a turning angle of a shroud-side blade shape that is an airfoil shape of an end surface on a shroud side, which is one side in the axial direction, in the vane body is different from a turning angle of a hub-side blade shape that is an airfoil shape of an end surface on a hub side, which is the other side in the axial direction, in the vane body, the airfoil shape of the vane body forms a continuous transition between the shroud-side blade shape and the hub-side blade shape, and the turning angle of the hub-side blade shape is smaller than the turning angle of the shroud-side blade shape.

According to the diffuser vane as described above, the turning angles of the hub-side blade shape and the shroud-side blade shape are different from each other and thus any one of the turning angles is smaller than the other of the turning angles. Since the turning angle is made small, it is possible to suppress separation while reducing the speed of the fluid. Therefore, by making the hub-side blade shape and the shroud-side blade shape different from each other corresponding to the speed distribution of the fluid flowing through the diffuser channel, it is possible to suppress separation of the entire diffuser vane.

Although depending on the shape of the impeller, there is a case where the hub side and the shroud side become different from each other in flow speed distribution of the fluid pressurized along from the impeller. Particularly, in a case where the flow speed of the fluid pressurized along from the impeller is low on the hub side and the diffuser vane has a blade shape constant in the blade height direction, the flow speed on the hub side may be excessively reduced and thus separation may occur at a stream on the hub side.

According to the aspect, the turning angle of the hub-side blade shape is smaller than the turning angle of the shroud-side blade shape and thus reduction of the speed of a stream on the hub side can be lessened. That is, excessive reduction of the speed of the stream on the hub side can be suppressed and thus separation of the stream can be avoided. Therefore, even in a case where particularly the flow rate becomes low, separation occurring within a formation range of the diffuser vane can be suppressed.

In the diffuser vane, it is preferable that the chord length of the hub-side blade shape is larger than the chord length of the shroud-side blade shape.

Accordingly, in a case where a degree of turning of the fluid per unit flow path length is referred to as a turning rate, the turning rate of the fluid on the hub side becomes smaller than the turning rate of the fluid on the shroud side. That is, the fluid is turned more gently on the hub side and thus separation of the fluid on the hub side can be further suppressed.

In the diffuser vane, the leading edge blade angle of the hub-side blade shape may be smaller than the leading edge blade angle of the shroud-side blade shape.

Accordingly, the leading edge blade angle of the hub-side blade shape is in a shape of being further inclined toward a circumferential direction from a radial direction than the leading edge blade angle of the shroud-side blade shape.

Accordingly, a stream is guided more gently and thus it is possible to further suppress separation on the hub side of the diffuser vane.

In the diffuser vane, in an axial view as seen in the axial direction, a leading edge of the hub-side blade shape and a leading edge of the shroud-side blade shape are positioned on the same first virtual circle around the axis, the leading edge of the hub-side blade shape is positioned rearward of the leading edge of the shroud-side blade shape in a rotating direction of the impeller, a trailing edge of the hub-side blade shape and a trailing edge of the shroud-side blade shape are positioned on the same second virtual circle around the axis, and the trailing edge of the hub-side blade shape is positioned forward of the trailing edge of the shroud-side blade shape in the rotating direction of the impeller.

Accordingly, the vane body has a shape that is twisted around a thick portion between the leading edge and the trailing edge toward the blade height direction. Therefore, the airfoil shape is not excessively warped near the leading edge or near the trailing edge when being twisted in the blade height direction and thus it is possible to realize a three-dimensional blade shape in a not forcible manner in terms of structure and strength of the diffuser vane.

In the diffuser vane, it is preferable that the vane body includes a two-dimensional airfoil shape portion that extends toward the hub side from the end surface on the shroud side while maintaining the shroud-side blade shape, and a three-dimensional airfoil shape portion that is connected to a hub side of the two-dimensional airfoil shape portion and transitions into the hub-side blade shape while continuously extending up to the end surface on the hub side to be twisted as seen in the view in the axial direction, and the three-dimensional airfoil shape portion is formed over a range of 50% or less of a blade height of the vane body.

Accordingly, the fluid can be turned at a turning angle constant in the blade height direction on the shroud side where the flow speed of the fluid pressurized along from the impeller is relatively high and a turning angle can be made small corresponding to the flow speed of a fluid on a hub-side region where the flow speed of the fluid becomes lower toward the hub side. Therefore, it is possible to apply appropriate speed reduction corresponding to the flow speed of a stream.

Meanwhile, in the diffuser vane, the turning angle of the shroud-side blade shape may be smaller than the turning angle of the hub-side blade shape.

Here, in a case where a return flow path where a stream of the fluid is turned toward the radial inner side is disposed downstream of the diffuser channel, at an outlet of the diffuser channel, that is, at an inlet of the return flow path, the flow speed of the fluid on the shroud side may be lower than the flow speed of the fluid on the hub side. In such a case, if the diffuser vane has a blade shape uniform in the blade height direction, the flow speed on the shroud side may be excessively reduced at the diffuser vane and thus separation may occur at a stream on the shroud side.

According to the aspect, the turning angle of the shroud-side blade shape is smaller than the turning angle of the hub-side blade shape and thus reduction of the speed of a stream on the shroud side can be lessened. That is, excessive reduction of the speed of the stream on the shroud side can be suppressed and thus separation of the stream on the shroud side near an outlet of the diffuser vane can be avoided. Therefore, even in a case where particularly the flow rate becomes low, separation occurring within a formation range of the diffuser vane can be suppressed.

In the diffuser vane, a chord length of the shroud-side blade shape may be larger than a chord length of the hub-side blade shape.

Accordingly, the turning rate of the fluid on the shroud side becomes smaller than the turning rate of the fluid on the hub side. That is, the fluid is turned more gently on the shroud side and thus separation of the fluid on the shroud side can be further suppressed.

In the diffuser vane, a leading edge blade angle of the shroud-side blade shape may be smaller than a leading edge blade angle of the hub-side blade shape.

Accordingly, the leading edge blade angle of the shroud-side blade shape is in a shape of being further inclined toward a circumferential direction from a radial direction than the leading edge blade angle of the hub-side blade shape. Accordingly, the stream is guided more gently and thus it is possible to further suppress separation on the shroud side of the diffuser vane.

In the diffuser vane, in an axial view as seen in the axial direction, a leading edge of the shroud-side blade shape and a leading edge of the hub-side blade shape are positioned on the same first virtual circle around the axis, the leading edge of the shroud-side blade shape is positioned rearward of the leading edge of the hub-side blade shape in a rotating direction of the impeller, a trailing edge of the shroud-side blade shape and a trailing edge of the hub-side blade shape are positioned on the same second virtual circle around the axis, and the trailing edge of the shroud-side blade shape is positioned forward of the trailing edge of the hub-side blade shape in the rotating direction of the impeller.

In this case also, it is possible to realize a three-dimensional blade shape in a not forcible manner in terms of structure and strength of the vane body as described above.

In the diffuser vane, the vane body may include a two-dimensional airfoil shape portion that extends toward the shroud side from the end surface on the hub side while maintaining the hub-side blade shape and a three-dimensional airfoil shape portion that is connected to a shroud side of the two-dimensional airfoil shape portion and transitions into the shroud-side blade shape while continuously extending up to the end surface on the shroud side to be twisted as seen in the view in the axial direction and the three-dimensional airfoil shape portion may be formed over a range of 50% or less of a blade height of the vane body.

Accordingly, a turning angle can be made small corresponding to the flow speed of a fluid on a shroud-side region where the flow speed of the fluid tends to become lower toward the shroud side. Therefore, it is possible to apply appropriate speed reduction corresponding to the flow speed of a stream.

According to a second aspect of the present invention, there is provided a centrifugal compressor including the impeller, a casing that accommodates the impeller and includes the diffuser channel that extends to the radial outer side from an outlet of the impeller and a return channel that is connected to a radial outer end portion of the diffuser channel and turns toward the radial inner side, and any one of the diffuser vanes described above.

Accordingly, it is possible to suppress separation on the hub side or the shroud side in the diffuser channel.

Advantageous Effects of Invention

According to a diffuser vane and a centrifugal compressor of the present invention, it is possible to suppress reduction in size of an operation range.

DESCRIPTION OF EMBODIMENTS

Hereinafter, a centrifugal compressor according to a first embodiment of the present invention will be described with reference to the drawings.

Figure 1:
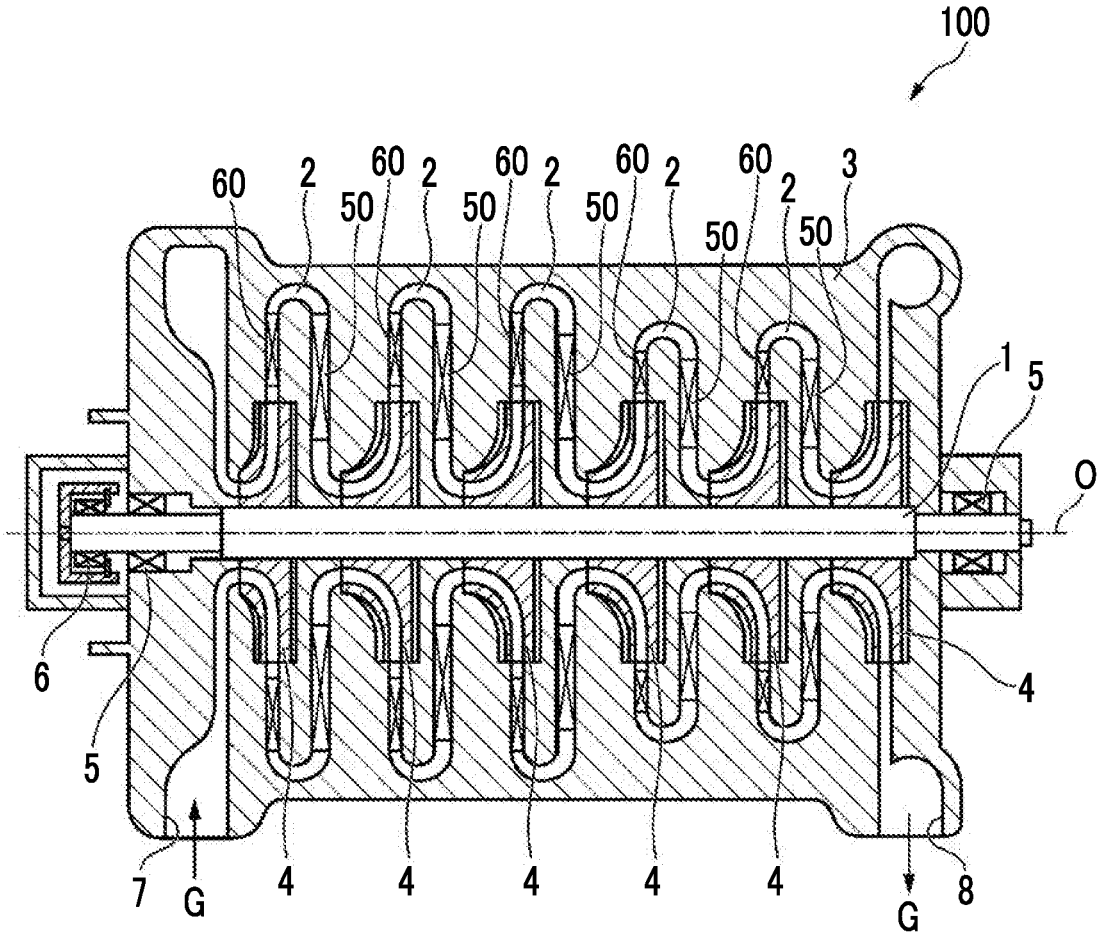
FIG. 1 is a longitudinal sectional view of a centrifugal compressor according to a first embodiment.

As shown in FIG. 1, a centrifugal compressor 100 includes a rotating shaft 1 that rotates around an axis, a casing 3 that covers the periphery of the rotating shaft 1 to form flow paths 2, a plurality of impellers 4 provided on the rotating shaft 1, and return vanes 50 and diffuser vanes 60 provided in the casing 3.

The casing 3 has a cylindrical shape extending along an axis O. The rotating shaft 1 extends to penetrate the inside of the casing 3 along the axis O. At opposite end portions of the casing 3 in a direction along the axis O, a journal bearing 5 and a thrust bearing 6 are provided, respectively. The rotating shaft 1 is supported by the journal bearing 5 and the thrust bearing 6 such that the rotating shaft 1 can rotate around the axis O.

On one side of the casing 3 in the direction along the axis O, a suction port 7 for taking in air as a working fluid G from the outside is provided. Furthermore, on the other side of the casing 3 in the direction along the axis O, a discharge port 8 through which the working fluid G compressed inside the casing 3 is discharged is provided.

Inside the casing 3, an internal space that communicates with the suction port 7 and the discharge port 8 and of which the diameter is reduced and increased repeatedly is formed. The internal space accommodates the plurality of impellers 4 and is a portion of the flow paths 2. Note that, in the following description, a side of the flow path 2 where the suction port 7 is positioned will be referred to as an upstream side and a side where the discharge port 8 is positioned will be referred to as a downstream side.

Figure 2:
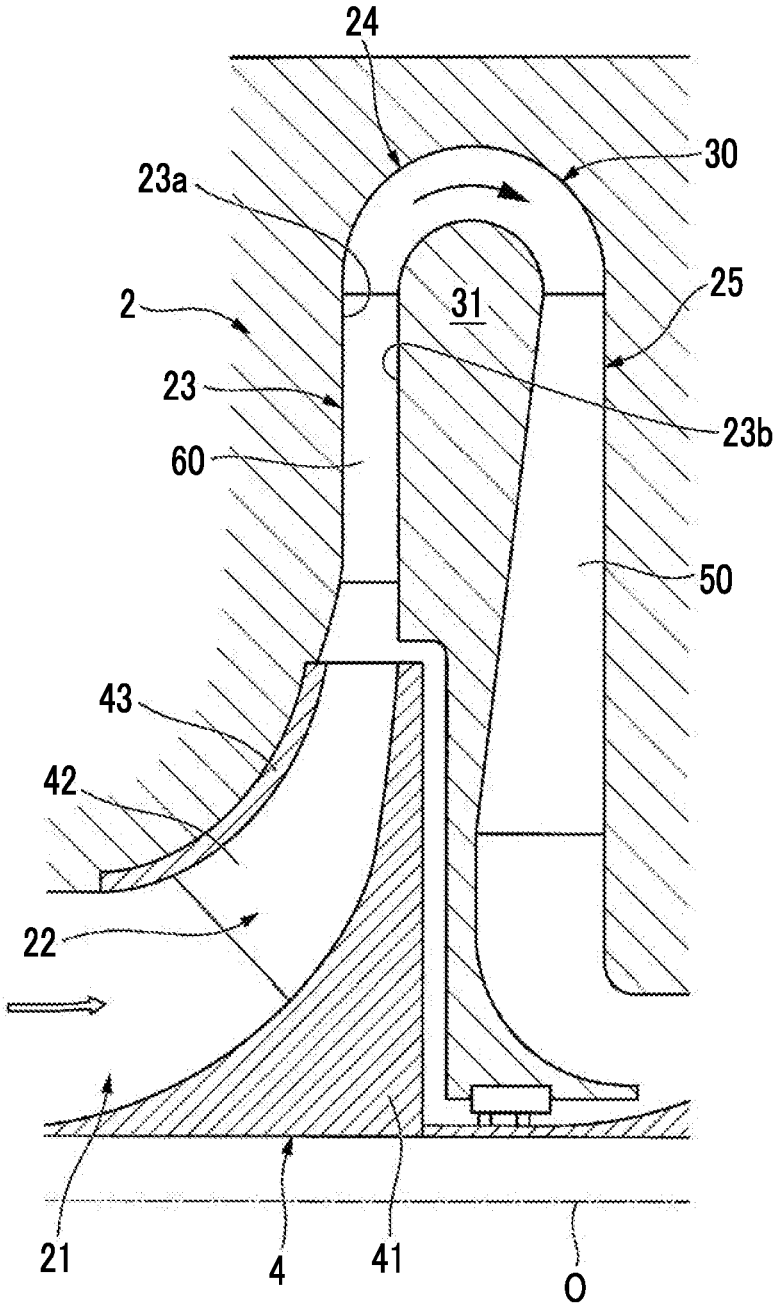
FIG. 2 is a longitudinal sectional view in which a portion of the centrifugal compressor according to the first embodiment is enlarged.

On an outer peripheral surface of the rotating shaft 1, the plurality of (six) impellers 4 are provided at intervals in the direction along the axis O. As shown in FIG. 2, each impeller 4 includes a disk 41 of which a section as seen in the direction along the axis O is substantially circular, a plurality of blades 42 provided on an upstream-side surface of the disk 41, and a cover 43 that covers the plurality of blades 42 from the upstream side.

The disk 41 has a conical shape by being formed such that a radial dimension gradually increases starting from the one side in the direction along the axis O toward the other side in the direction along the axis O as seen in a direction intersecting the axis O.

The plurality of blades 42 are radially arranged around the axis O while facing a radial outer side on a conical surface from among opposite surfaces of the disk 41 in the direction along the axis O, the conical surface facing the upstream side. More specifically, these blades are formed by means of thin plates erected toward the upstream side from the upstream-side surface of the disk 41. The plurality of blades 42 are curved from one side in a circumferential direction to the other side in the circumferential direction as seen in the direction along the axis O.

The cover 43 is provided on upstream side edges of the blades 42. In other words, the plurality of blades 42 are interposed between the cover 43 and the disk 41 in the direction along the axis O. Accordingly, a space is formed between the cover 43, the disk 41, and a pair of adjacent blades 42. The space is a portion (compression flow path 22) of the flow path 2, which will be described later.

The flow paths 2 are spaces through which the impellers 4 configured as described above and the internal space of the casing 3 communicate with each other. In the present embodiment, the description will be made assuming that one flow path 2 is formed for one impeller 4 (for one compression stage). That is, in the centrifugal compressor 100, consecutive five flow paths 2 are formed in a direction from the upstream side to the downstream side to correspond to five impellers 4 other than the impeller 4 of the last stage.

Each flow path 2 includes a suction flow path 21, the compression flow path 22, a diffuser channel 23, and a return channel 30.

In the case of the impeller 4 of the first stage, the suction flow path 21 is directly connected to the suction port 7. Via the suction flow path 21, air from the outside is taken into each flow path on the flow paths 2 as the working fluid G. More specifically, the suction flow path 21 is gradually curved radially outward from the direction along the axis O starting from the upstream side toward the downstream side.

Each of the suction flow paths 21 in the impellers 4 of second and subsequent stages communicates with a downstream end of a guide flow path 25 in the flow path 2 of a preceding stage. That is, a direction in which the working fluid G passing through the guide flow path 25 flows is changed such that the working fluid G is directed to the downstream side along the axis O as described above.

The compression flow path 22 is a flow path surrounded by the upstream-side surface of the disk 41, a downstream-side surface of the cover 43, and a pair of blades 42 adjacent to each other in the circumferential direction. More specifically, the sectional area of the compression flow path 22 decreases starting from a radial inner side toward a radial outer side. Accordingly, the working fluid G flowing through the compression flow path 22 in a state where the impeller 4 is rotated is gradually compressed and becomes a high-pressure fluid.

The diffuser channel 23 is a flow path that extends outward from a radial inner side with respect to the axis O. A radial inner end portion of the diffuser channel 23 communicates with a radial outer end portion of the compression flow path 22. A wall surface in the casing 3 that forms the diffuser channel 23 and is on one side in the direction along the axis O is a shroud side wall surface 23*a* that extends to be orthogonal to the axis O. A wall surface in the casing 3 that forms the diffuser channel 23 and is on the other side in the direction along the axis O is a hub side wall surface 23*b* that extends to be orthogonal to the axis O. The diffuser channel 23 is formed to be interposed between the shroud side wall surface 23*a* and the hub side wall surface 23*b* in the direction along the axis O.

The return channel is a flow path where the working fluid G flowing to the radial outer side is turned toward the radial inner side to flow into the impeller 4 of the next stage. The return channel is formed by a return bend portion 24 and the guide flow path 25.

At the return bend portion 24, a direction in which the working fluid G flowing to the radial outer side from the radial inner side after flowing through the diffuser channel 23 flows is reversed to a direction toward the radial inner side. One end side (upstream side) of the return bend portion 24 communicates with the diffuser channel 23 and the other end side (downstream side) thereof communicates with the guide flow path 25. In the middle of the return bend portion 24, a portion positioned on the radial outermost side is a top portion. In the vicinity of the top portion, an inner wall surface of the return bend portion 24 forms a three-dimensional curved surface so as not to hinder the flow of the working fluid G.

The guide flow path 25 extends radially inward from a downstream-side end portion of the return bend portion 24. A radial outer end portion of the guide flow path 25 communicates with the return bend portion 24. The radial inner end portion of the guide flow path 25 communicates with the suction flow path 21 of the flow path 2 in a subsequent stage, as described above.

A plurality of the return vanes 50 are provided in the guide flow path 25 of the return channel 30. The plurality of return vanes 50 are radially arranged around the axis O inside the guide flow path 25. In other words, the return vanes 50 are arranged around the axis O at intervals in the circumferential direction. Opposite ends of each return vane in an axial direction are in contact with the casing 3 forming the guide flow path 25.

Next, the diffuser vanes 60 will be described. The diffuser vanes 60 (vane bodies) are provided in the diffuser channel 23. A plurality of the diffuser vanes 60 are provided at intervals in the circumferential direction around the axis O. Opposite ends of each diffuser vane 60 in the direction along the axis O are fixed to the shroud side wall surface 23*a* and the hub side wall surface 23*b*. Accordingly, the diffuser vanes 60 are integrally provided with the casing 3.

Figure 3:
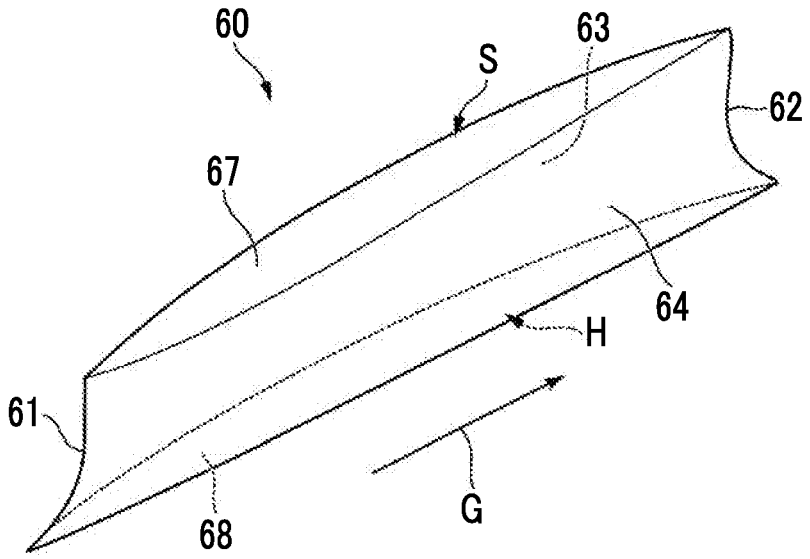
FIG. 3 is a first perspective view of a diffuser vane in the centrifugal compressor according to the first embodiment.
Figure 4:
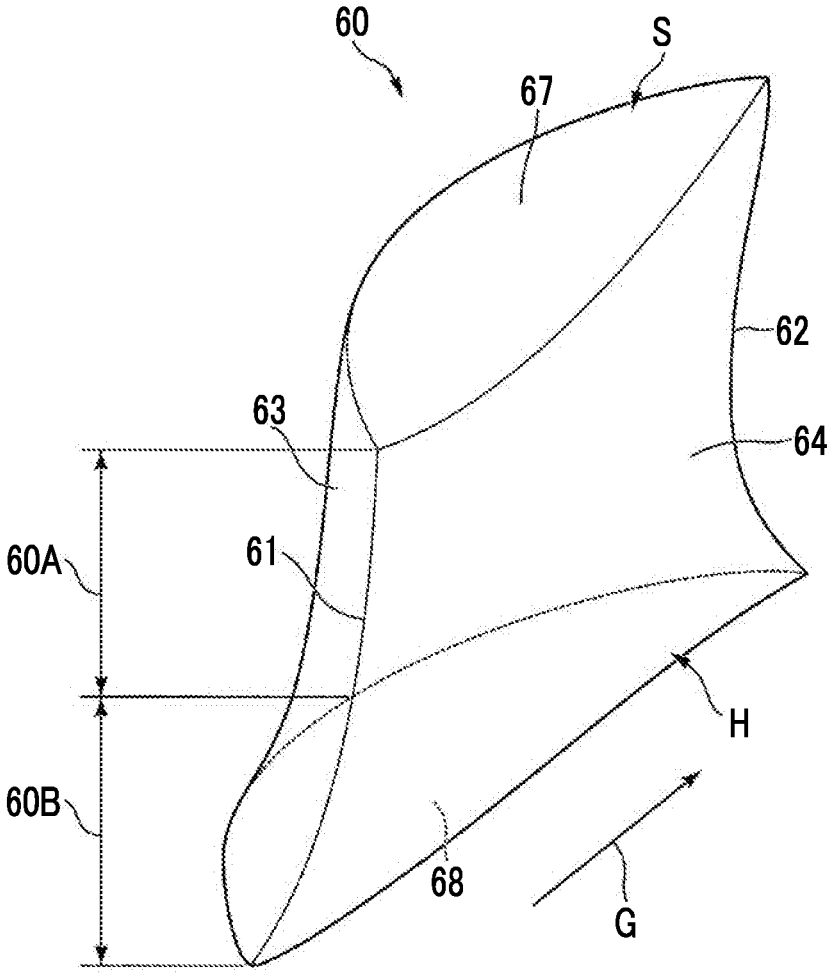
FIG. 4 is a second perspective view of the diffuser vane in the centrifugal compressor according to the first embodiment.

As shown in FIGS. 3 and 4, the diffuser vane 60 has an airfoil shape of which a blade height direction is aligned with the direction along the axis O (direction in which shroud side wall surface 23*a* and hub side wall surface 23*b* face each other). That is, the diffuser vane 60 has an airfoil shape in cross section orthogonal to the axis O over the entire region in the direction along the axis O.

The diffuser vane 60 extends to a front side in a rotating direction R of the impeller 4 toward the radial outer side. Accordingly, the diffuser vane 60 is disposed in a posture of being inclined with respect to a radial direction of the axis O in a view in the direction along the axis O as seen in the direction along the axis O.

A radial inner end portion of the diffuser vane 60 is a leading edge 61 of the airfoil shape of the diffuser vane 60. A radial outer end portion of the diffuser vane 60 is a trailing edge 62. That is, the diffuser vane 60 extends to the radial outer side and the front side in the rotating direction R of the impeller 4, starting from the leading edge 61 toward the trailing edge 62.

A surface of the diffuser vane 60 that faces a rear side in the rotating direction R is a pressure surface 63. A surface of the diffuser vane 60 that faces a front side in the rotating direction R is a suction surface 64. The airfoil shape of the diffuser vane 60 is formed by the pressure surface 63 and the suction surface 64. A connection place between the pressure surface 63 and the suction surface 64 at a radial inner end portion is the leading edge 61 of the diffuser vane 60 and a connection place at a radial outer end portion is the trailing edge 62 of the diffuser vane 60.

The pressure surface 63 is formed by curved lines or straight lines that continue from the leading edge 61 to the trailing edge 62. The pressure surface 63 has an outwardly curved surface-like shape that protrudes toward the rear side in the rotating direction R of the impeller 4. The suction surface 64 is formed by curved lines or straight lines that continue from the leading edge 61 to the trailing edge 62. The suction surface 64 has an outwardly curved surface-like shape that protrudes toward the front side in the rotation direction R of the impeller 4. Note that, the pressure surface and the suction surface 64 may have an inwardly curved surface-like shape partially or entirely. Each of the pressure surface 63 and the suction surface 64 is formed to continue in the blade height direction.

As shown in FIG. 4, the diffuser vane 60 is composed of a two-dimensional airfoil shape portion 60A and a three-dimensional airfoil shape portion 60B. The two-dimensional airfoil shape portion 60A is a portion of the diffuser vane 60 that is on a shroud side (one side in direction along axis O) in the blade height direction (vertical direction in FIG. 4). The three-dimensional airfoil shape portion 60B is a portion of the diffuser vane 60 that is on a hub side (other side in direction along axis O) in the blade height direction. The two-dimensional airfoil shape portion 60A and the three-dimensional airfoil shape portion 60B are connected to each other to be aligned with each other. In the present embodiment, the three-dimensional airfoil shape portion 60B is formed over a range of 50% or less of a blade height from the hub side wall surface 23*b*. The three-dimensional airfoil shape portion 60B is preferably formed over a range of 10% or more in the blade height direction from the hub side wall surface 23*b*, is more preferably formed over a range of 20% or more, and is still more preferably formed over a range of 30% or more.

The two-dimensional airfoil shape portion 60A is a portion that extends in the blade height direction while maintaining the same airfoil shape. Here, the airfoil shape of a shroud side end surface 67, which is an end surface of the two-dimensional airfoil shape portion 60A that is on one side in the direction along the axis O (end surface of diffuser vane 60 that is on one side in direction along axis O), will be referred to as a shroud-side blade shape S. The two-dimensional airfoil shape portion 60A extends in the blade height direction while maintaining the shroud-side blade shape S.

The three-dimensional airfoil shape portion 60B is a portion where the airfoil shape continuously changes toward the blade height direction. Here, the airfoil shape of a hub side end surface 68, which is an end surface of the three-dimensional airfoil shape portion 60B that is on the other side in the direction along the axis O (end surface of diffuser vane 60 that is on other side in direction along axis O), will be referred to as a hub-side blade shape H. The three-dimensional airfoil shape portion 60B is connected to the two-dimensional airfoil shape portion 60A while extending such that the hub-side blade shape H continuously changes starting from the hub side toward the shroud side. That is, the three-dimensional airfoil shape portion 60B is connected to a hub side of the two-dimensional airfoil shape portion 60A and continuous transition from the shroud-side blade shape S, which is the airfoil shape of the two-dimensional airfoil shape portion 60A, to the hub-side blade shape H is gradually made toward the hub side. The hub-side blade shape H is the shape of the hub side end surface 68 of the diffuser vane 60.

Figure 5:
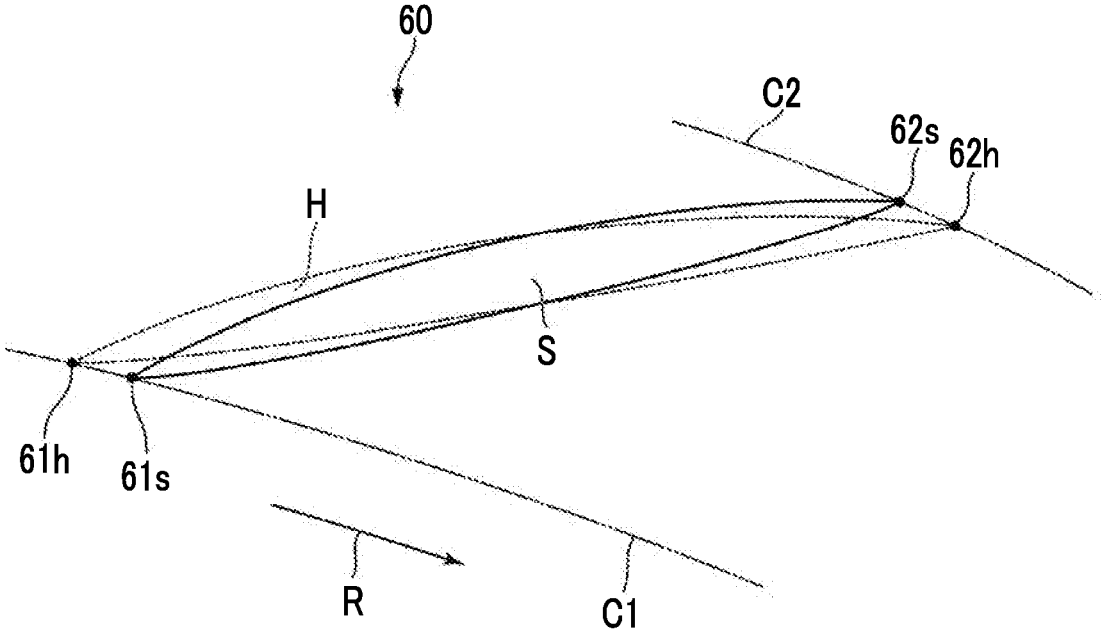
FIG. 5 is a schematic view of the diffuser vane in the centrifugal compressor according to the first embodiment as seen from one side in an axial direction.

The shroud-side blade shape S and the hub-side blade shape H will be described with reference to FIG. 5. In FIG. 5, the shroud-side blade shape S is represented by solid lines, and the hub-side blade shape H is represented by broken lines.

In a view in the direction along the axis O as seen in the direction along the axis O, a leading edge 61*s* of the shroud-side blade shape S and a leading edge 61*h* of the hub-side blade shape H are positioned on the same first virtual circle C1 extending around the axis O. The leading edge 61*h* of the hub-side blade shape H is positioned rearward of the leading edge 61*s* of the shroud-side blade shape S in the rotating direction R of the impeller 4.

In a view in the direction along the axis O as seen in the direction along the axis O, a trailing edge 62*s* of the shroud-side blade shape S and a trailing edge 62*h* of the hub-side blade shape H are positioned on the same second virtual circle C2 extending around the axis O. The radius of the second virtual circle C2 is larger than that of the first virtual circle C1. The trailing edge 62*h* of the hub-side blade shape H is positioned forward of the trailing edge 62*s* of the shroud-side blade shape S in the rotating direction R of the impeller 4. A distance between the leading edge 61*s* of the shroud-side blade shape S and the leading edge 61*h* of the hub-side blade shape H is preferably the same as a distance between the trailing edge 62*s* of the shroud-side blade shape S and the trailing edge 62*h* of the hub-side blade shape H. That is, it is preferable that the shift amounts of the leading edges 61*h* and 61*s* and the trailing edges 62*h* and 62*b* in the circumferential direction are the same as each other.

A distance between the leading edge 61*h* and the trailing edge 62*h* of the hub-side blade shape H is larger than a distance between the leading edge 61*s* and the trailing edge 62*s* of the shroud-side blade shape S. That is, the chord length of the hub-side blade shape H is larger than the chord length of the shroud-side blade shape S.

In addition, the transition from the shroud-side blade shape S to the hub-side blade shape H is made like being twisted around a centerline passing through the vicinity of the center of the chord length of an airfoil shape.

Figure 6:
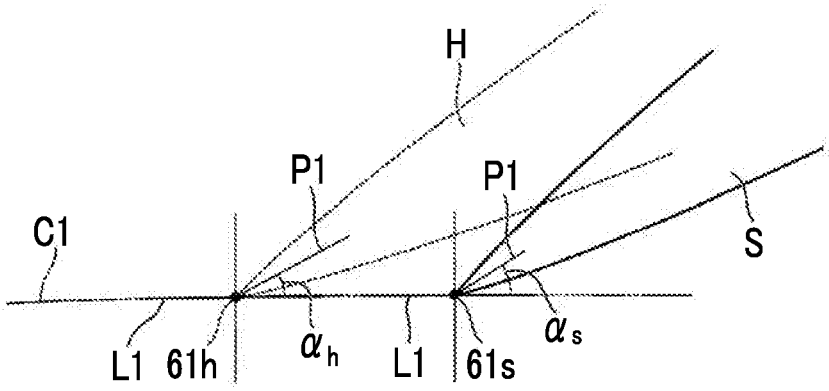
FIG. 6 is an enlarged view of the vicinity of a leading edge in FIG. 5.

Here, as shown in FIG. 6, a leading edge blade angle $\alpha_h$ of the hub-side blade shape H is smaller than a leading edge blade angle $\alpha_s$ of the shroud-side blade shape S. The leading edge blade angles are acute angles formed by tangential lines L1 to the first virtual circle C1 at points where the leading edges 61*s* and 61*h* are positioned and tangential lines P1 to the centerlines of the airfoil shapes at the leading edges 61*s* and 61*h*.

Figure 7:
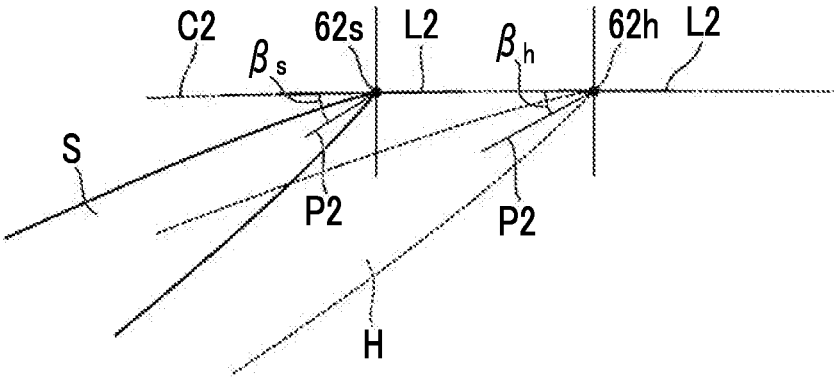
FIG. 7 is an enlarged view of the vicinity of a trailing edge in FIG. 5.

As shown in FIG. 7, a trailing edge blade angle $\beta_h$ of the hub-side blade shape H is smaller than a trailing edge blade angle $\beta_s$ of the shroud-side blade shape S. A trailing edge blade angle is an acute angle formed by a tangential line L2 to the second virtual circle C2 at a point where the trailing edge 62 is positioned and a tangential line P2 to the centerline of an airfoil shape at the trailing edge 62.

The turning angle of the shroud-side blade shape S and the turning angle of the hub-side blade shape H are different from each other. In the present embodiment, the turning angle of the hub-side blade shape H is smaller than the turning angle of the shroud-side blade shape S. The turning angle of the shroud-side blade shape S is obtained by a difference ($\alpha_s$-$\beta_s$) between the leading edge blade angle and the trailing edge blade angle of the shroud-side blade shape S. The turning angle of the hub-side blade shape H is obtained by a difference ($\alpha_h$-$\beta_h$) between the leading edge blade angle and the trailing edge blade angle of the hub-side blade shape H.

Next, the operation and effect of the first embodiment will be described.

According to the centrifugal compressor 100 including the diffuser vane 60 configured as described above, the turning angles of the hub-side blade shape H and the shroud-side blade shape S are different from each other and thus any one of the turning angles is smaller than the other of the turning angles. Since the turning angle is made small, it is possible to suppress separation while reducing the speed of the working fluid G. Therefore, by making the hub-side blade shape H and the shroud-side blade shape S different from each other corresponding to the speed distribution of a fluid flowing through the diffuser channel 23, it is possible to suppress separation of the entire diffuser vane 60.

Here, although depending on the shape of the impeller 4 of the centrifugal compressor 100, there is a case where the hub side and the shroud side become different from each other in flow speed distribution of the working fluid G pressurized along from the impeller 4. For example, in a case where the flow speed of the working fluid G pressurized along from the impeller 4 is relatively low on the hub side and is relatively high on the shroud side, the flow speed of the working fluid G introduced into a region in the diffuser channel 23 where the diffuser vane 60 is formed becomes lower starting from the shroud side toward the hub side.

In this case, if the diffuser vane 60 has an airfoil shape with a blade shape being uniform in the blade height direction, the flow speed on the hub side may be excessively reduced and thus separation may occur at a stream on the hub side. That is, in a case where speed reduction is made on the shroud side and the hub side at the same ratio, the flow speed on the hub side becomes excessively low earlier than the shroud side and thus a boundary layer cannot be formed between the diffuser vane and the hub side wall surface 23*b*.

Figure 8:
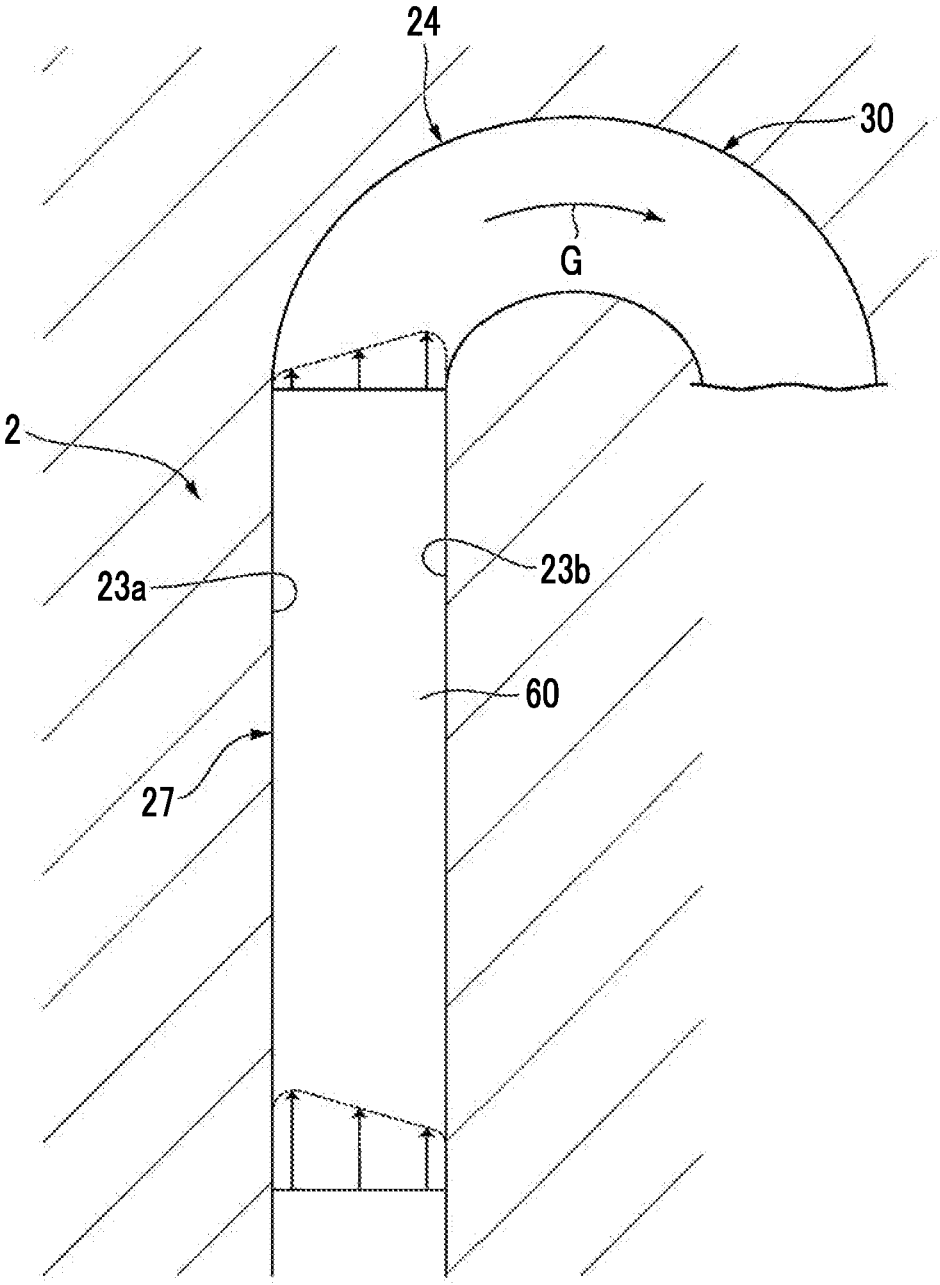
FIG. 8 is a schematic view for describing the operation and effect of the first embodiment.

However, in the present embodiment, in the case of the airfoil shape of the diffuser vane 60, the turning angle of the hub-side blade shape H is set to be smaller than the turning angle of the shroud-side blade shape S. The smaller a turning angle is, the smaller a speed reduction rate is. Therefore, reduction of the speed of the working fluid G on the hub side can be lessened. That is, as shown in FIG. 8, since excessive reduction of the speed of the working fluid G on the hub side can be suppressed, separation of a stream of the working fluid G can be suppressed. Therefore, even in a case where the flow rate of the working fluid G pressurized along from the impeller 4 becomes low, separation occurring within a formation range of the diffuser vane 60 can be suppressed. Accordingly, reduction in size of an operation range in the centrifugal compressor 100 in which the diffuser vane 60 is used can be suppressed particularly on a low flow rate side.

Furthermore, in the case of the diffuser vane 60 of the present embodiment, the chord length of the hub-side blade shape H is larger than the chord length of the shroud-side blade shape S. Therefore, in a case where a degree of turning of the working fluid G per unit flow path length is referred to as a turning rate, the turning rate of a fluid on the hub side becomes smaller than the turning rate of the working fluid G on the shroud side. That is, a fluid is turned more gently on the hub side and thus excessive speed reduction on the hub side can be further suppressed and separation of the working fluid G on the hub side can be further suppressed.

In addition, in the case of the diffuser vane 60 of the present embodiment, the leading edge blade angle $\alpha_h$ of the hub-side blade shape H is smaller than the leading edge blade angle $\alpha_s$ of the shroud-side blade shape S. Therefore, the leading edge blade angle of the hub-side blade shape H is in a shape of being further inclined toward the circumferential direction from the radial direction than the leading edge blade angle of the shroud-side blade shape S, that is, a lying shape. Therefore, a stream is guided more gently and thus it is possible to further suppress separation on the hub side of the diffuser vane 60.

Furthermore, in the present embodiment, the diffuser vane 60 has a shape that is twisted around a thick portion (vicinity of center of chord length) between the leading edge 61 and the trailing edge 62 toward the blade height direction. In a case where the center of the twisting of an airfoil shape is near the leading edge 61 and near the trailing edge 62, the airfoil shape needs to be extremely warped near the leading edge 61 or the near the trailing edge 62. However, in the present embodiment, since the center of the twisting is the thick portion, no airfoil shape is excessively warped.

Therefore, it is possible to realize a three-dimensional blade shape in a not forcible manner in terms of structure and strength of the diffuser vane 60.

In addition, in the present embodiment, the three-dimensional airfoil shape portion 60B is formed over a range of 50% or less of a blade height in a hub-side region of the diffuser vane 60. Accordingly, a fluid can be turned at a turning angle constant in the blade height direction on the shroud side where the flow speed of the working fluid G pressurized along from the impeller 4 is relatively high and a turning angle can be made small corresponding to the flow speed of a fluid on the hub-side region where the flow speed of the working fluid G becomes lower toward the hub side. Therefore, it is possible to apply appropriate speed reduction corresponding to the flow speed of the working fluid G.

Next, a diffuser vane 160 of a second embodiment will be described with reference to FIGS. 9, 10A, and 10B. The diffuser vane 160 (vane body) of the second embodiment is in a relationship with the diffuser vane 60 of the first embodiment in which the shroud-side blade shape S and the hub-side blade shape H are reversed.

In the case of the diffuser vane 160 of the second embodiment, the three-dimensional airfoil shape portion 60B which is shown in FIG. 4 in the first embodiment is positioned on the shroud side and the two-dimensional airfoil shape portion 60A is positioned on the hub side. The range of the three-dimensional airfoil shape portion 60B in the blade height direction is a region of 50% or less and 10% or more of a blade height with the shroud side wall surface 23*a* as the standard and is preferably a region of 30% or more thereof.

Figure 9:
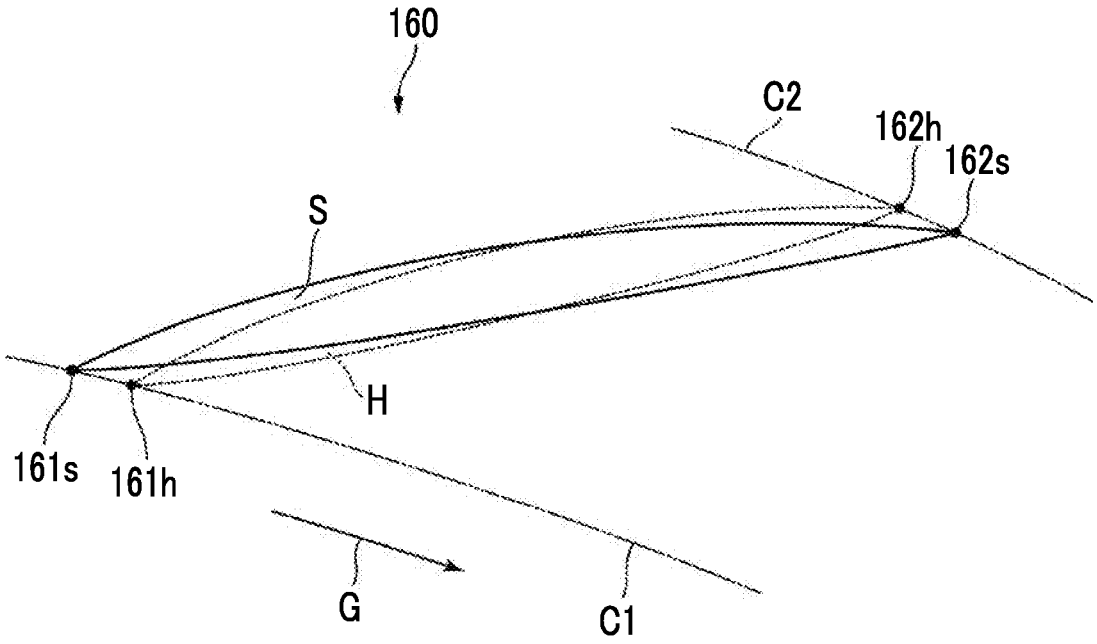
FIG. 9 is a schematic view of a diffuser vane according to a second embodiment as seen from the one side in the axial direction.
Figure 10A:
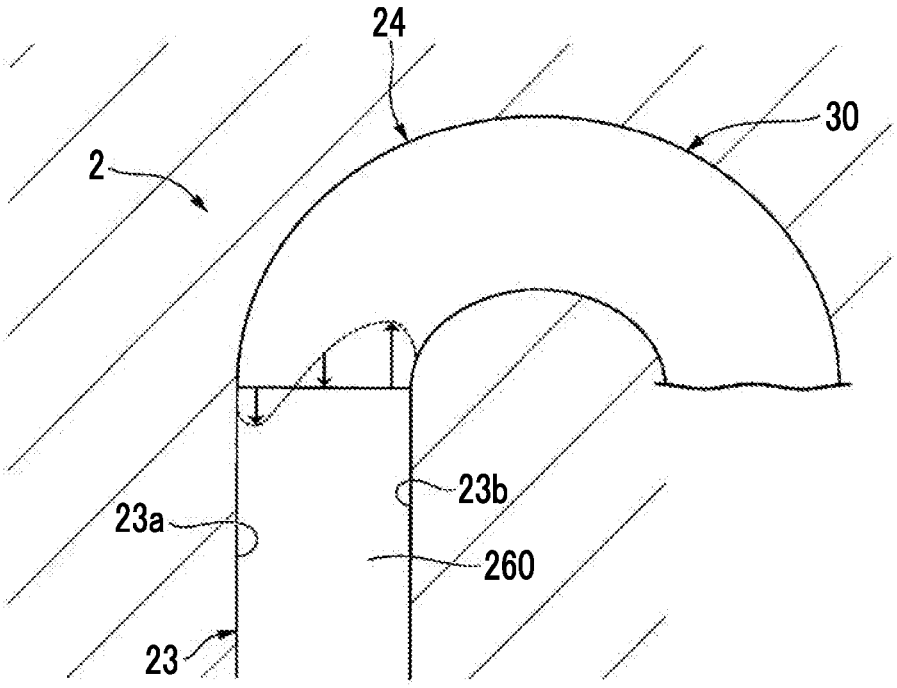
FIG. 10A is a schematic view for describing the operation and effect of the second embodiment.
Figure 10B:
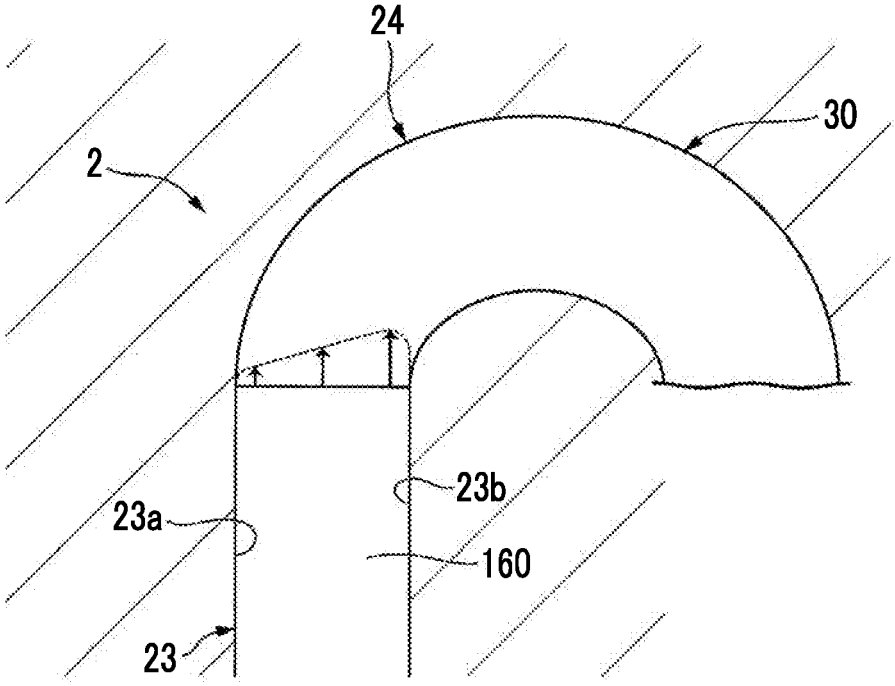
FIG. 10B is another schematic view for describing the operation and effect of the second embodiment.

In addition, as shown in FIG. 9, in the case of the diffuser vane 160 of the second embodiment, regarding a leading edge 161*s* of the shroud-side blade shape S and a leading edge 161*h* of the hub-side blade shape H which are on the first virtual circle C1, the leading edge 161*s* of the shroud-side blade shape S is positioned on a rear side in the rotating direction R. Regarding a trailing edge 162*s* of the shroud-side blade shape S and a trailing edge 162*h* of the hub-side blade shape H which are on the second virtual circle C2, the trailing edge 162*s* of the shroud-side blade shape S is positioned on a front side in the rotating direction R. Therefore, the chord length of the shroud-side blade shape S is larger than the chord length of the hub-side blade shape H. In addition, the transition from the shroud-side blade shape S to the hub-side blade shape H is made like being twisted around a centerline passing through the vicinity of the center of the chord length of an airfoil shape.

Furthermore, in the second embodiment, the leading edge blade angle of the shroud-side blade shape S is smaller than the leading edge blade angle of the hub-side blade shape H. The trailing edge blade angle of the shroud-side blade shape S is smaller than the trailing edge blade angle of the hub-side blade shape H. The turning angle of the shroud-side blade shape S is smaller than the turning angle of the hub-side blade shape H.

Here, in a case where the return channel 30 where a stream of the working fluid G is turned toward the radial inner side is disposed downstream of the diffuser channel 23, at an outlet of the diffuser channel 23, that is, at an inlet of the return bend portion 24 of the return channel 30, the flow speed of the working fluid G on the shroud side may be lower than the flow speed of the working fluid G on the hub side. If a diffuser vane 260 of which a blade shape is uniform in the blade height direction as shown in FIG. 10A is used in such a case, the flow speed is excessively reduced on the shroud side at the diffuser vane 260 and thus separation may occur at a stream on the shroud side.

However, in the case of the diffuser vane 160 of the second embodiment, the turning angle of the shroud-side blade shape S is smaller than the turning angle of the hub-side blade shape H and thus reduction of the speed of a stream on the shroud side can be lessened. That is, since excessive reduction of the speed of the stream on the shroud side can be suppressed, as shown in FIG. 10B, the speed of the stream on the shroud side is not extremely reduced near an outlet of the diffuser vane 160. As a result, separation near the diffuser vane 160 can be avoided. Therefore, even in a case where particularly the flow rate of the working fluid G pressurized along from the impeller 4 becomes low, separation occurring within a formation range of the diffuser vane 160 can be suppressed.

In addition, in the case of the diffuser vane 160 of the second embodiment, the chord length of the shroud-side blade shape S is larger than the chord length of the hub-side blade shape H and thus a turning rate on the shroud side is lower than a turning rate on the hub side. That is, a fluid is turned more gently on the shroud side and thus separation of the working fluid G on the shroud side can be further suppressed.

Furthermore, in the case of the diffuser vane 160 of the second embodiment, the leading edge blade angle of the shroud-side blade shape S is smaller than the leading edge blade angle of the hub-side blade shape H and thus the leading edge blade angle of the shroud-side blade shape S is in a lying shape of being further inclined toward the circumferential direction from the radial direction more than the leading edge blade angle of the hub-side blade shape H. Therefore, a stream is guided more gently and thus it is possible to further suppress separation on the shroud side of the diffuser vane 160.

Hereinabove, the embodiments of the present invention have been described. However, the present invention is not limited thereto and appropriate modification can be made without departing from the technical idea of the invention.

INDUSTRIAL APPLICABILITY

The present invention relates to a diffuser vane and a centrifugal compressor. According to the present invention, it is possible to suppress reduction in size of an operation range in a centrifugal compressor in which a diffuser vane is used.

REFERENCE SIGNS LIST

1 rotating shaft
2 flow path
3 casing
4 impeller
5 journal bearing
6 thrust bearing
7 suction port
8 discharge port
21 suction flow path
22 compression flow path
23 diffuser channel
23*a* shroud side wall surface
23*b* hub side wall surface
24 return bend portion
25 guide flow path
30 return channel
41 disk
42 blade
43 cover
50 return vane
60 diffuser vane
61 leading edge
61*h* leading edge
61*s* leading edge
62 trailing edge
62*h* trailing edge
62*s* trailing edge
63 pressure surface
64 suction surface
60*a* two-dimensional airfoil shape portion
60*b* three-dimensional airfoil shape portion
67 shroud side end surface
68 hub side end surface
100 centrifugal compressor
160 diffuser vane
161*h* leading edge
161*s* leading edge
162*h* trailing edge
162*s* trailing edge
260 diffuser vane
R rotating direction
G working fluid
S shroud-side blade shape
H hub-side blade shape
C1 first virtual circle
L1 tangential line
P1 tangential line
C2 second virtual circle
L2 tangential line
P2 tangential line
$\alpha_s$ leading edge blade angle of shroud-side blade shape
$\alpha_h$ leading edge blade angle of hub-side blade shape
$\beta_s$ trailing edge blade angle of the shroud-side blade shape
$\beta_h$ trailing edge blade angle of hub-side blade shape

The invention claimed is:

1. A diffuser vane which is provided in a diffuser channel through which a fluid that is sucked in by an impeller rotating around an axis from one side in an axial direction and is pressurized along to a radial outer side flows, a plurality of the diffuser vanes being provided in the diffuser channel at intervals in a circumferential direction of the axis, the diffuser vane comprising:

a vane body, of which a blade height direction is aligned with the axial direction and which has an airfoil shape in cross section orthogonal to the blade height direction, extends toward a front side in a rotating direction of the impeller, starting from a leading edge at an end portion on a radial inner side toward the radial outer side and reaches a trailing edge at an end portion on the radial outer side, wherein a turning angle of a shroud-side blade shape that is an airfoil shape of an end surface on a shroud side, which is one side in the axial direction, in the vane body is different from a turning angle of a hub-side blade shape that is an airfoil shape of an end surface on a hub side, which is the other side in the axial direction, in the vane body and the airfoil shape of the vane body forms a continuous transition between the shroud-side blade shape and the hub-side blade shape, and wherein the turning angle of the hub-side blade shape is smaller than the turning angle of the shroud-side blade shape.

2. The diffuser vane according to claim 1, wherein a chord length of the hub-side blade shape is larger than a chord length of the shroud-side blade shape.

3. The diffuser vane according to claim 2, wherein a leading edge blade angle of the hub-side blade shape is smaller than a leading edge blade angle of the shroud-side blade shape.

4. The diffuser vane according to claim 1, wherein, in an axial view as seen in the axial direction, a leading edge of the hub-side blade shape and a leading edge of the shroud-side blade shape are positioned on the same first virtual circle around the axis, the leading edge of the hub-side blade shape is positioned rearward of the leading edge of the shroud-side blade shape in the rotating direction of the impeller, a trailing edge of the hub-side blade shape and a trailing edge of the shroud-side blade shape are positioned on the same second virtual circle around the axis, and the trailing edge of the hub-side blade shape is positioned forward of the trailing edge of the shroud-side blade shape in the rotating direction of the impeller.

5. The diffuser vane according to claim 1, wherein the vane body includes a two-dimensional airfoil shape portion that extends toward the hub side from the end surface on the shroud side while maintaining the shroud-side blade shape, and a three-dimensional airfoil shape portion that is connected to a hub side of the two-dimensional airfoil shape portion and transitions into the hub-side blade shape while continuously extending up to the end surface on the hub side such that the airfoil shape is changed, and wherein the three-dimensional airfoil shape portion is formed over a range of 50% or less of a blade height of the vane body.

6. The diffuser vane according to claim 1, wherein the turning angle of the shroud-side blade shape is smaller than the turning angle of the hub-side blade shape.

7. The diffuser vane according to claim 6, wherein a chord length of the shroud-side blade shape is larger than a chord length of the hub-side blade shape.

8. The diffuser vane according to claim 6, wherein a leading edge blade angle of the shroud-side blade shape is smaller than a leading edge blade angle of the hub-side blade shape.

9. The diffuser vane according to claim 6, wherein, in an axial view as seen in the axial direction, a leading edge of the shroud-side blade shape and a leading edge of the hub-side blade shape are positioned on the same first virtual circle around the axis, the leading edge of the shroud-side blade shape is positioned rearward of the leading edge of the hub-side blade shape in the rotating direction of the impeller, a trailing edge of the shroud-side blade shape and a trailing edge of the hub-side blade shape are positioned on the same second virtual circle around the axis, and the trailing edge of the shroud-side blade shape is positioned forward of the trailing edge of the hub-side blade shape in the rotating direction of the impeller.

10. The diffuser vane according to claim 6, wherein the vane body includes a two-dimensional airfoil shape portion that extends toward the shroud side from the end surface on the hub side while maintaining the hub-side blade shape, and a three-dimensional airfoil shape portion that is connected to a shroud side of the two-dimensional airfoil shape portion and transitions into the shroud-side blade shape while continuously extending up to the end surface on the shroud side such that the airfoil shape is changed, and wherein the three-dimensional airfoil shape portion is formed over a range of 50% or less of a blade height of the vane body.

11. A centrifugal compressor comprising:

the impeller;

a casing that accommodates the impeller and includes the diffuser channel that extends to the radial outer side from an outlet of the impeller and a return channel that is connected to a radial outer end portion of the diffuser channel and turns toward the radial inner side; and the diffuser vane according to claim 1.

* * * * *